United States Patent [19]

St. Germain

[11] 4,240,659

[45] * Dec. 23, 1980

[54] HEAVY DUTY SLING CONSTRUCTION

[75] Inventor: Dennis St. Germain, Wilmington, Del.

[73] Assignee: I & I Sling Company, Inc., Aston, Pa.

[ * ] Notice: The portion of the term of this patent subsequent to Aug. 23, 1994, has been disclaimed.

[21] Appl. No.: 940,944

[22] Filed: Sep. 11, 1978

[51] Int. Cl.[3] ..... B66C 1/18

[52] U.S. Cl. ..... 294/74

[58] Field of Search ..... 294/74, 75; 57/201, 57/202, 237; 87/8

[56] References Cited

U.S. PATENT DOCUMENTS

| | | | |
|---|---|---|---|
| 1,703,269 | 2/1929 | Garris | 87/8 X |
| 2,082,828 | 6/1937 | Garris | 294/74 X |
| 2,133,071 | 10/1938 | Anderson et al. | 57/237 |
| 2,325,261 | 7/1943 | Mazzella | 294/74 X |
| 2,412,895 | 12/1946 | Lewis | 294/74 X |
| 4,043,581 | 8/1977 | St. Germain | 294/74 |

*Primary Examiner*—Johnny D. Cherry

*Attorney, Agent, or Firm*—Anthony J. McNulty

[57] ABSTRACT

An improved sling construction for lifting heavy loads is disclosed. The sling is formed by intertwining a multiplicity of three body part slings or subslings which in turn are woven from single cables in such a manner that they have a body having an eye at each end thereof. The construction of the sling is such that when the particular application calling for such a sling is completed, it may be readily disassembled enabling reuse of the constituent subslings. A second construction for lifting very heavy loads is also disclosed.

7 Claims, 3 Drawing Figures

HEAVY DUTY SLING CONSTRUCTION

BACKGROUND OF THE INVENTION

This invention relates to a sling construction for heavy duty slings and the like and to methods for assembling such slings. More specifically, it relates to composite structures made from individual components which when fully assembled are capable of being used for very heavy jobs yet are readily adaptable to being disassembled to form a multiplicity of light duty slings.

SUMMARY OF THE INVENTION

One problem encountered when very heavy loads such as power station steam turbines or offshore oil drilling rigs must be lifted or moved is the high cost of the heavy duty slings and cables used to attach the load to the power source. For such loads, which may easily exceed 100 tons, it is not uncommon to order specially made cable slings to handle them. However, because of the heavy weight and lack of flexibility of such slings, the relatively low frequency of their use and the difficulty and the costs of refurbishing and storing them after use, it is also uncommon to discard them after the immediate needs have passed. Of course, the costs of replacing these slings for the next application, when and if one arises, are passed on by the rigger to the customer of his services and ultimately to the public at large. It would be much better if a way were available to assemble special heavy duty slings when a need for them arises, from lighter duty components which, upon subsequent disassembly, could be readily salvaged for use in normal rigging and hauling applications. Most recently there has been developed a technique for fabricating light and medium duty cable slings which show an unusually high degree of flexibility. This is a woven sling construction described by St. Germain in U.S. Pat. No. 4,043,581.

In this a sling is woven from a single continuous length of cable. The resultant sling has a three body part, or a body made of three cable sections, loosely woven or twisted together. An eye is formed at each end of the body of the sling. Each eye is woven from two loops of cable. The sling is woven so that an end cable is positioned at a juncture of the eye and body. The end of the cable is secured to only one of the three cable sections which form the body.

The resulting sling is very flexible, due to the loose weave of the cable making up the body and eyes. The cable ends are redundantly secured to the sling body through the use of a flemish eye and a sleeve. Costs and weight are kept to a minimum by securing the cable ends to only one of the three cable sections forming the body of the sling. The cost is reduced not only due to the fact that a smaller and therefore less expensive sleeve may be used but because smaller sleeves require smaller presses or other force fitting equipment to secure the sleeve effectively to the body. The securing of the cable end to only one of the three sections making up the body also directly increases the flexibility of the sling as the eye formed by the two loops is freer to move with respect to the sling body than it otherwise would be if the end were secured to all three sections of cable making up the body of the sling.

In the preferred embodiment of the present invention a composite heavy duty sling is formed by intertwining a plurality of lighter duty type subslings so as to form a single cable sling. The degree of intertwining necessary is not particularly great so that such an operation can be easily conducted in the field with normal rigging gang personnel so the investment required to produce the composite cable need not be much higher than that to purchase the component slings. When assembled the composite structure retains a high degree of the inherent flexibility exhibited by its individual components.

Unraveling during handling is prevented by relatively simple serving or clamps applied close to the eyes of the composite structure. Furthermore, when the clamps or serving are removed the individual component slings are easily recovered and can be put back into use for the more normal, lighter duty lifting and hauling applications for which they are designed. By so doing the contractor is spared both the time and almost all of the expenses of procuring special, limited use of heavy duty cables.

Accordingly, it is an object of the present invention to provide a heavy duty cable construction which can be fabricated in the field.

It is a further object of the present invention to provide a heavy duty cable construction which can be assembled from lighter duty, flexible component subslings.

It is an additional object of the present invention to provide a heavy duty sling construction which can be easily disassembled into its constituent components each of which can be readily used for subsequent lighter duty loads.

It is still a further object of the present invention to provide a heavy duty sling construction which is flexible.

It is yet a further object of the present invention to provide a low cost heavy duty sling.

Other objects and advantages of this invention will become apparent in the description which follows taken together with the accompanying drawings.

DESCRIPTION OF THE PREFERRED EMBODIMENT

Figure 1:
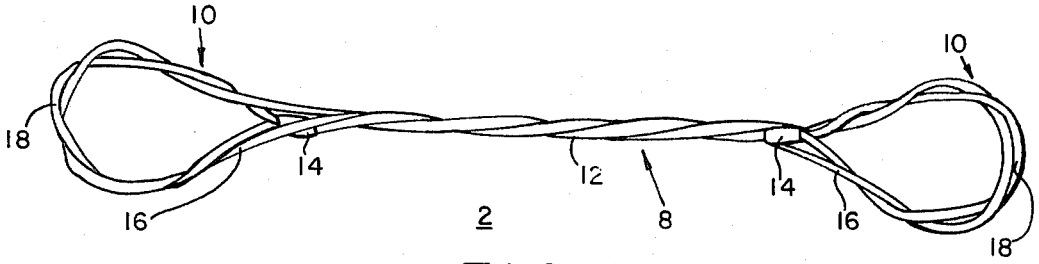
FIG. 1 PRIOR ART
FIG. 1 is a plane view of a three part light duty cable sling.

The basic building block of the subject invention is a flexible subsling cable as described by St. Germain in U.S. Pat. No. 4,043,581. Referring now to FIG. 1 we see a view of such a three element light duty cable subsling 2. As shown the entire sling 2 including the body 8 and the eyes 10 is made from one continuous length of cable 12. The two ends of the cable 12 are secured by sleeves 14 to portions of the cable itself. The body 8 is made up of three sections of cable 12 or three "parts" as they are referred to by persons familiar with the art to which this invention pertains. Each eye 10 is made up of two loops 16 and 18 which are each formed, of course, by cable 12. Loop 18 is the closure loop and is the loop formed by cable 12 when an end thereof is doubled back onto itself and secured by sleeve 14. One characteristic of this construction is that the three parts of cable 12 in forming body 8 of the sling are only loosely woven together. Similarly cable 12 is only loosely woven in forming loops 16 and 18, thus forming the eyes 10. This loose weaving of cable 12 is important in providing the high degree of flexibility exhibited by cable slings of this type.

Figure 2:
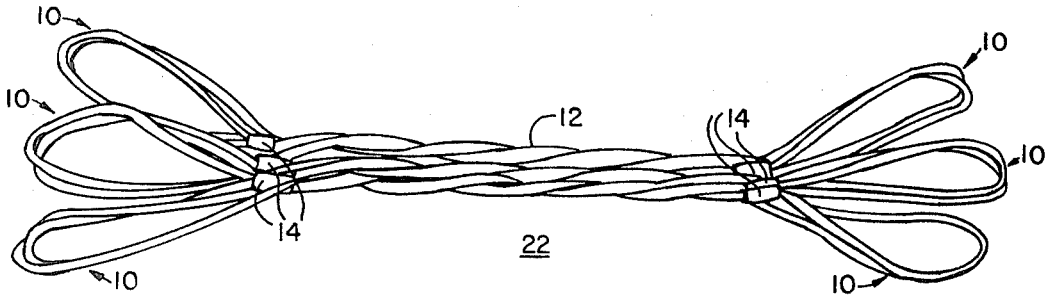
FIG. 2 is a plane view of a nine part heavy duty cable.

The preferred embodiment of the present invention is shown in FIG. 2 and is an outgrowth of the three body part sling designed and fabricated as described above. The invention consists in combining at least a pair of three body part subslings 2 to form another sling having a greater load carrying capacity. In the preferred embodiment of the present invention three subslings are combined to form a nine body part "heavy duty" sling 22. A sling of this type is designed to carry a load of approximately 150 tons. In another embodiment of the present invention (not shown) a "very heavy duty" sling is formed by combining nine subslings to form a twenty-seven body part sling. This embodiment of the invention will carry a load of approximately 400 tons. Other configurations having a different number of body parts may also be constructed. The actual load carrying capability of slings constructed according to the present invention will vary depending upon the characteristics of cable 12 which is used in fabricating the three body part subslings 2.

The nine body part sling 22 shown in FIG. 2 may be fabricated by suspending two subslings 2 shown in FIG. 1 from a common hook and loosely intertwining them. The intertwining should not be too great so as to reduce flexibility of the resultant structure. Sling 22 is completed when a third subsling 2 is then intertwined with the other two intertwined subslings 2. The third subsling is intertwined so that it fits into the plate cleft running spirally down the length of the two intertwined subslings 2.

Figure 3:
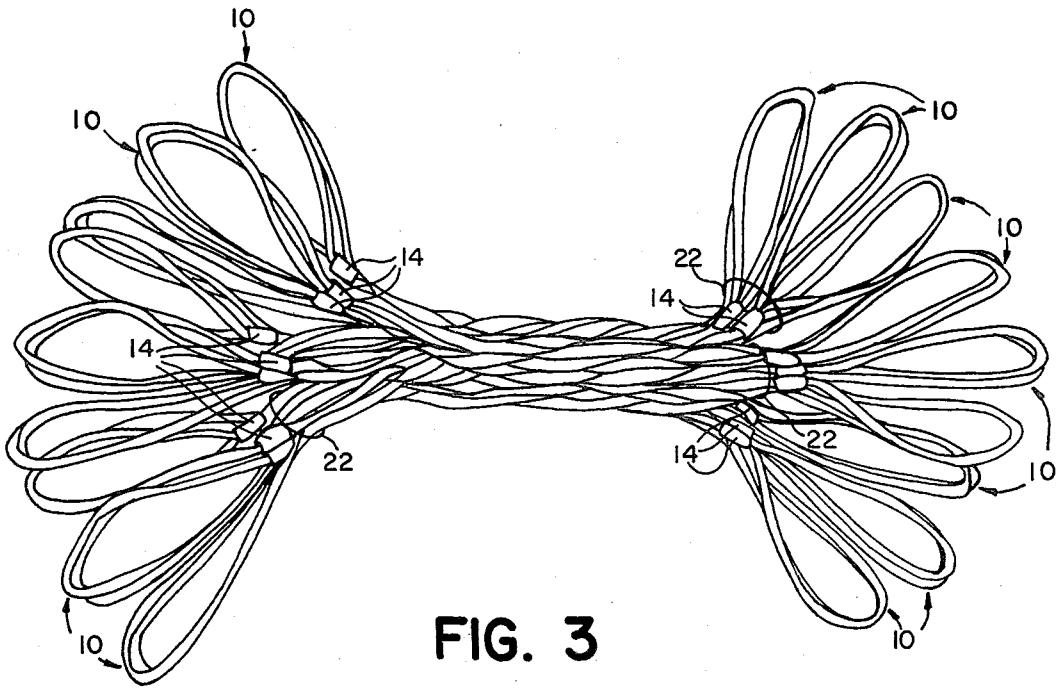
FIG. 3 is a plane view of a twenty-seven part heavy duty cable.

The twenty-seven part very heavy duty sling, shown in FIG. 3, is made in a similar manner. However, the intertwining operation is done with a set of three nine part slings 22 instead of starting with a larger number of subslings 2. This greatly simplifies the ease with which these large composites can be assembled.

In addition to having superior load bearing capability and flexibility, the composite part structures show another valuable feature as well. It has been found that in the final twisted design the detents or sub-body part sleeves 14 present at each end effectively interfere with each other so as that the normal tendency for an unloaded loosely woven cable to unravel is greatly reduced compared to that which might normally be expected to occur. The net effect of this latter feature is an enhanced structural integrity even when the distal end loop bases are not fastened together. Where extra protection against unraveling is needed a simple U Bolt or similar device, such as wire serving or steel banding straps, to fit around and clamp the loop bases together will generally suffice. Such devices are readily found in most operations. Thus, for most uses the expense of the constituent lighter duty three part cables used as the subslings is the main and essentially only cost involved. Of course, removing the clamps (if present) and manually unplatting cable 12 quickly, easily and inexpensively salvages the cable for refurbishment (if necessary) and reuse for the more normal rigging uses for which they are designed. Such reuse will constitute a significant economy for the rigger. As an example of this economy, it has been estimated that a single set of four very heavy duty twenty-seven part four inch cables having an individual lift capacity of about 120 tons could be provided to lift, say, a large steam turbine for considerably less financial strain than would be required to fabricate a set of four "standard" very heavy duty woven cables for the same purpose. As noted these savings are further enhanced by the ability to use thirty six light duty subslings 2 after this particular need has passed.

Numerous variations and modifications of the above described invention will occur to those skilled in the art in light of this disclosure and prior art. It is contemplated therefore, that the present invention may be practiced otherwise than specifically described herein while remaining within the scope of the following claims which define the invention.

What is claimed is:

1. A flexible load carrying apparatus which comprises first and second slings wherein each sling is a three body part sling constructed of a single length of flexible cable and includes:

a body having three intertwined sections of said cable; and an eye at each end of said body, each eye including two intertwined sections of said cable, each eye having at its juncture with said body an end of said cable, said ends being secured to a body section of said cable by a sleeve, said sleeve each thereby securing only two sections of said cable, and wherein said bodies of said first and second slings are intertwined and maintained intertwined by maintaining means which include the engagement of said sleeves, on a random basis, with adjacent sleeves and cables, said sleeves fitting into interstices there between thus forming an interlocking relationship, said maintaining means permitting said apparatus to be easily and readily engaged and disengaged from said slings.

2. The apparatus of claim 1 which further includes a third sling, said third sling being substantially identical to said first and second slings, said body of said third sling being intertwined with said bodies of said first and second slings and maintained intertwined by said maintaining means thereby forming a first nine body part device having a body and eyes at opposite ends thereof.

3. The apparatus of claim 2 which further comprises second and third nine body part devices, said second and third nine body part devices being substantially identical to said first nine body part device, said bodies of said devices being intertwined and maintained intertwined by said maintaining means, thereby forming a twenty-seven body part load carrying device.

4. The apparatus of claims 1, 2, or 3 wherein said sleeve is metal.

5. A method of forming a flexible load carrying apparatus which includes the following steps:

intertwining first and second slings wherein each sling is a three body part sling constructed of a single length of flexible cable and includes:

a body having three intertwining sections of said cable; and an eye at each end of said body, each eye including two intertwined sections of said cable, each eye having at its juncture with said body an end of said cable, said ends being secured to a body section of said cable by a sleeve, said sleeve each thereby securing only two sections of said cable and wherein said bodies of said first and second slings are intertwined; and maintaining said bodies of said first and second slings intertwined by maintaining means which include the engagement of said sleeves, on a random basis, with adjacent sleeves and cables, said sleeves fitting into interstices there between, thus forming an interlocking relationship, said maintaining means permitting said apparatus to be easily and readily engaged and disengaged from said slings.

6. The method of claim 5 which includes intertwining a third sling with said first and second slings, said third sling being substantially identical to said first and second slings, by intertwining the body of said third sling with the bodies of said first and second slings, and maintaining said first, second, and third bodies intertwined by said maintaining means thereby forming a first nine body part device having a body, and eyes at opposite ends thereof.

7. The method of claim 6 which includes intertwining second and third nine body part devices, said second and third nine body part devices being substantially identical to said first nine body part device, said bodies of said devices being intertwined and maintained intertwined by said maintaining means, thereby forming a twenty-seven body part load carrying device.

* * * * *